US007464432B2

(12) United States Patent
Goller

(10) Patent No.: US 7,464,432 B2
(45) Date of Patent: Dec. 16, 2008

(54) WEIGHTED TROWEL WITH ELONGATED HANDLE

(75) Inventor: Herbert Goller, Pittsburgh, PA (US)

(73) Assignee: Ardex, L.P., Aliquippa, PA (US)

( * ) Notice: Subject to any disclaimer, the term of this patent is extended or adjusted under 35 U.S.C. 154(b) by 636 days.

(21) Appl. No.: 11/023,819

(22) Filed: Dec. 28, 2004

(65) Prior Publication Data

US 2006/0137125 A1 Jun. 29, 2006

(51) Int. Cl.
*B05C 17/10* (2006.01)

(52) U.S. Cl. ..... 15/245.1; 15/235.4; 15/236.01; 30/169; 30/172

(58) Field of Classification Search ..... 15/235.4, 15/236.01, 245, 245.1; 30/169, 171, 172; 37/285; 294/54.5
See application file for complete search history.

(56) References Cited

U.S. PATENT DOCUMENTS

| | | | | | |
|---|---|---|---|---|---|
| 72,993 | A * | 1/1868 | Fleckenstine | ..... | 15/245 |
| 731,762 | A * | 6/1903 | Draeger | ..... | 15/236.01 |
| 911,536 | A * | 2/1909 | Banke | ..... | 15/145 |
| 1,383,873 | A * | 7/1921 | Stine | ..... | 30/171 |
| 2,008,221 | A * | 7/1935 | Molander | ..... | 15/245 |
| 2,062,998 | A * | 12/1936 | Peterson | ..... | 30/140 |
| 2,261,475 | A * | 11/1941 | Kautenberg | ..... | 15/245 |
| 2,846,764 | A * | 8/1958 | Hyneman | ..... | 30/172 |
| 3,803,662 | A | 4/1974 | Glejf | | |
| 4,982,470 | A | 1/1991 | Szabo | | |
| 5,379,479 | A | 1/1995 | Nelson | | |
| 5,460,461 | A | 10/1995 | McGrath | | |
| 5,778,482 | A * | 7/1998 | Sbrigato | ..... | 15/245.1 |
| 6,308,370 | B1 | 10/2001 | Southby | | |
| 2005/0251945 | A1 * | 11/2005 | Fortune | ..... | 15/245.1 |

* cited by examiner

*Primary Examiner*—Mark Spisich
(74) *Attorney, Agent, or Firm*—Arnold B. Silverman; Eckert Seamans Cherin & Mellott, LLC

(57) ABSTRACT

Several embodiments of trowels which have an elongated handle and a pair of generally facing weights or a weight or weights and a connector between which a pair of blades are secured with one blade being of lesser height than the other to thereby resist undesired flexing of the other blade. In another embodiment, in lieu of having a second blade, a second weight which is disposed on the opposite side of the blade from the handle, has a downward extension which limits flexing of the blade. In a further embodiment, a blade is a two component blade and has a detachable and replaceable cutting edge. The weights and connector serve a multiple purpose of securing the upper end of the blades therebetween, facilitating downward pressure when the trowel is in use and in some embodiments through either a second blade or an extension of a weight for limiting the amount of flexing of the blade.

17 Claims, 4 Drawing Sheets

WEIGHTED TROWEL WITH ELONGATED HANDLE

BACKGROUND OF THE INVENTION

1. Field of the Invention

The present invention relates to a trowel having an elongated handle and blades clamped therebetween such that either multiple blades or extensions of weights limit the flexing of the blade and contribute to securement of the blades and efficient use.

2. Description of the Prior Art

U.S. Pat. No. 5,460,461 discloses a manual concrete screed handle wherein the elongated handle is secured to a clamping plier that receives and clamps a screed member.

U.S. Pat. No. 3,803,662 is directed toward a carpet adhesive spreader and has a serrated blade and mounting member hinged to a frame member between push and pull stops. The frame member is pivotally connected to a long handle and pivots about an axis perpendicular to the handle to control the flow of excess adhesive.

U.S. Pat. No. 4,982,470 discloses a manually operable device for applying adhesive to floor coverings which permits the user to remain in standing position. The device has an elongated handle and an operating rod which is separately gripped and is connected to a serrated spatula which has an irregular lower surface.

U.S. Pat. No. 6,308,370 discloses an adhesive spreader which has a blade having a rectangular planar portion with a plurality of indentations and a pair of generally perpendicular flange portions. Gripping is effected directly over the rectangular planar portion.

U.S. Pat. No. 5,379,479 discloses a long handle adhesive spreader having a housing which receives an upper end of a blade and overlying upwardly projecting pins which receive weights thereon for providing a downward force on the blade. There is no positioning of the weights laterally of the blades, no clamping of the blades between weights, and no suggestion of limiting flexing of the blade during use by either the weights or other means.

There remains, therefore, a very real and substantial need for an improved long handle trowel which will in a controlled and efficient manner permit spreading of adhesive and the like.

SUMMARY OF THE INVENTION

The present invention has met the above described need by providing a trowel with an elongated handle with a pair of adjacent weights. In a first embodiment, a first trowel blade is secured between the weights and extends downwardly therefrom with a second trowel blade secured adjacent thereto also between the weights with the second blade being of lesser height than the first blade. The weights function to restrain the blades in desired positions and serve to add weight to the operating end of the tool. The second blade functions to limit the amount of flexing of the first blade in use.

In one embodiment, a connector has a portion which is secured to the lower portion of the handle and another portion which is secured directly or indirectly to the weights and interposed blades.

In another embodiment, one of the weights has a downwardly projecting extension which limits the amount of blade flexure in use.

In a further embodiment, the blade is a multi-piece blade having interchangeable cutting edges.

It is an object of the present invention to provide an improved trowel for standup spreading of adhesives and the like while effectively restraining the upper blade portions between weights which contribute to performance while limiting undesired blade flexing.

It is a further object of the present invention to provide systems which have positive structure inhibiting undesired blade flexing in use.

It is yet another object of the present invention to provide such a trowel wherein the weights serve multiple purposes.

It is yet another object of the present invention to provide improved structure for securing a handle to the weight and blade assembly.

These and other objects of the invention will be more fully understood from the following detailed description of the invention on reference to the illustrations appended hereto.

DESCRIPTION OF THE PREFERRED EMBODIMENTS

Figure 1:
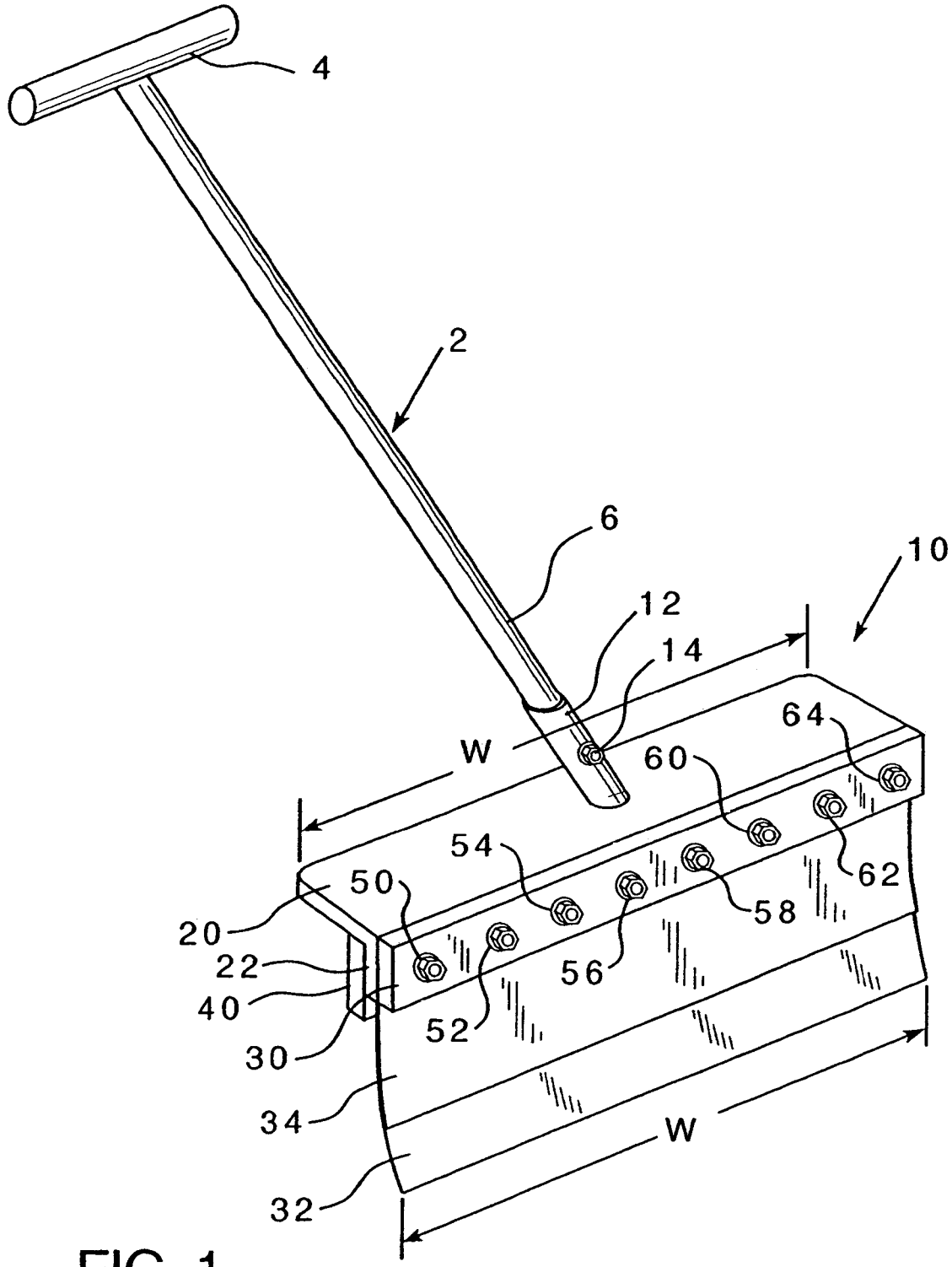
FIG. 1 is a perspective view of a form of the present long handled trowel showing an embodiment having two blades.
Figure 2:
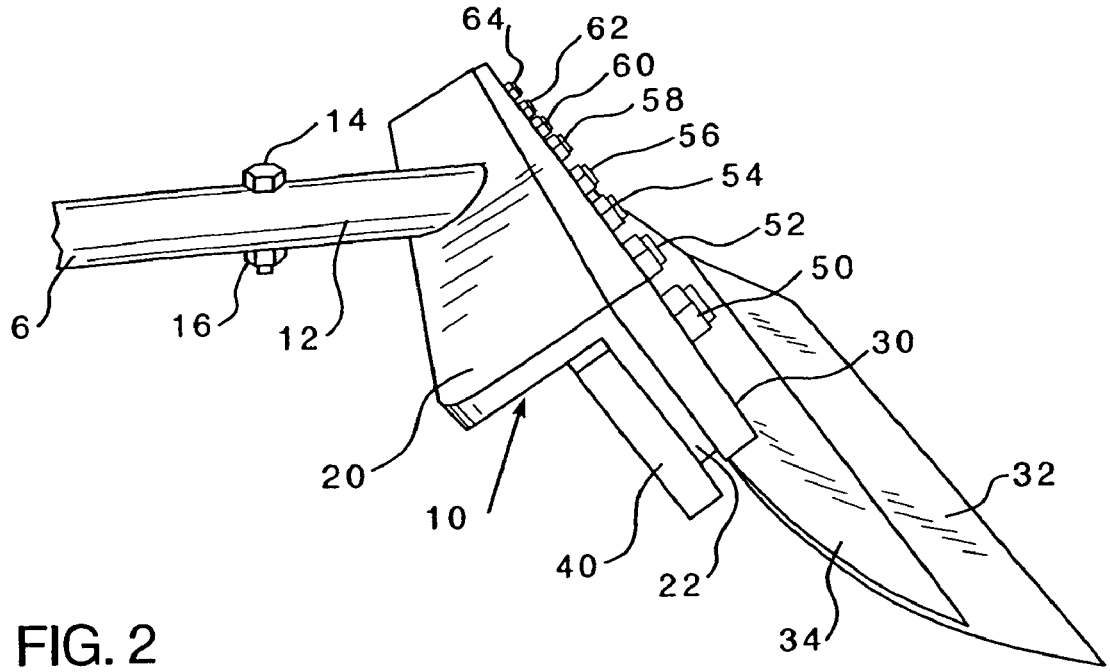
FIG. 2 is a left side perspective of a portion of the trowel of FIG. 1.
Figure 3:
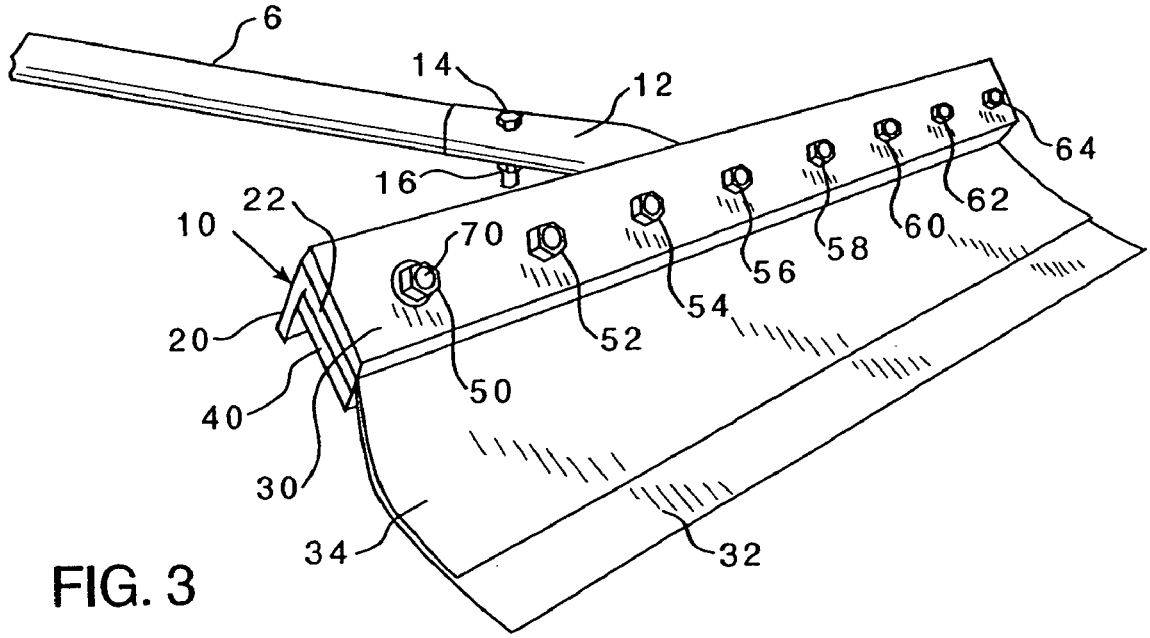
FIG. 3 is an angular front perspective showing a portion of the trowel of FIG. 1.

Referring to FIGS. 1-3, there is shown a trowel having an elongated handle 2 with a gripping portion 4 oriented generally transverse to the elongated handle portion 6. While there is no specific critical length, the handle portion 6 will generally have a length in the range of about 4 to 7 feet and preferably 5 to 6 feet in order to permit the individual using the trowel to remain in an upright or generally upright position. At the lower end of the generally straight handle section is a connector 10 which has an angularly disposed tubular portion 12 which receives and secures the handle section 6. In the form shown, the handle section 6, which extends into tubular portion 12, is secured thereto by bolt 14 and nut 16 (FIGS. 2 and 3) to thereby establish an integral connection therebetween. The connector 10 has a width W which will generally be coextensive with the blade as described hereinafter. In the form shown, connector 10 is generally L-shaped and has a portion 20 to which tubular member 12 is secured and weight securing flange 22. Connector 10 is preferably made of a substantially rigid material such as steel or aluminum for example.

A first weight member 30 has an inner surface disposed on one side of an elongated first blade 32 adjacent to which is positioned a second blade 34 with both blades 32,34 having upper ends clampingly secured between the connector flange 22 and the first weight 30. A second weight 40 is disposed adjacent an inner surface of an inner surface of flange 22 with a plurality of mechanical fasteners such as bolts for example, secured to retainers 50, 52, 54, 56, 58, 60, 62, 64, which may take the form of nuts which are secured to bolts having their head adjacent the inner surface of weight 40 and shown for example as bolt 70, which is secured in position by nut 50. It will be appreciated in this manner, the connector 10, first weight 30, second weight 40, blades 32,34 will be clamped in intimate relationship with the upper portions of the blades 32,34 clamped between the inner surface of weight 30 and the outer surface of flange 22 with or without any intermediate material.

In general, weights 30, 40 will be generally of the same size, shape and weight. These weights serve not only to clamp the blades for secure retention, but also provide a downward force which facilitates sufficient spreading of the adhesive and reinforcement of the second blade 34 so as to resist undesired flexing of first blade 32.

In a preferred form, the connector flange 22, first weights 30 and second weight 40, and blades 32,34 will all have substantially the same width W.

The blades 32,34 may be made of any suitable material, although sheet metal will generally be the preferable material. First blade 32 will flex during use and second blade 34 will limit the amount of flexing which will occur so as to provide far more efficient distribution of the adhesive. The lower end of blade 32 will preferably have a serrated edge in order to facilitate spreading of the adhesive efficiently. In a preferred relationship, the height of the second blade 34 measured from its upper edge to its lower edge will be about 50 to 70 percent of the height of the first blade 32.

Figure 4:
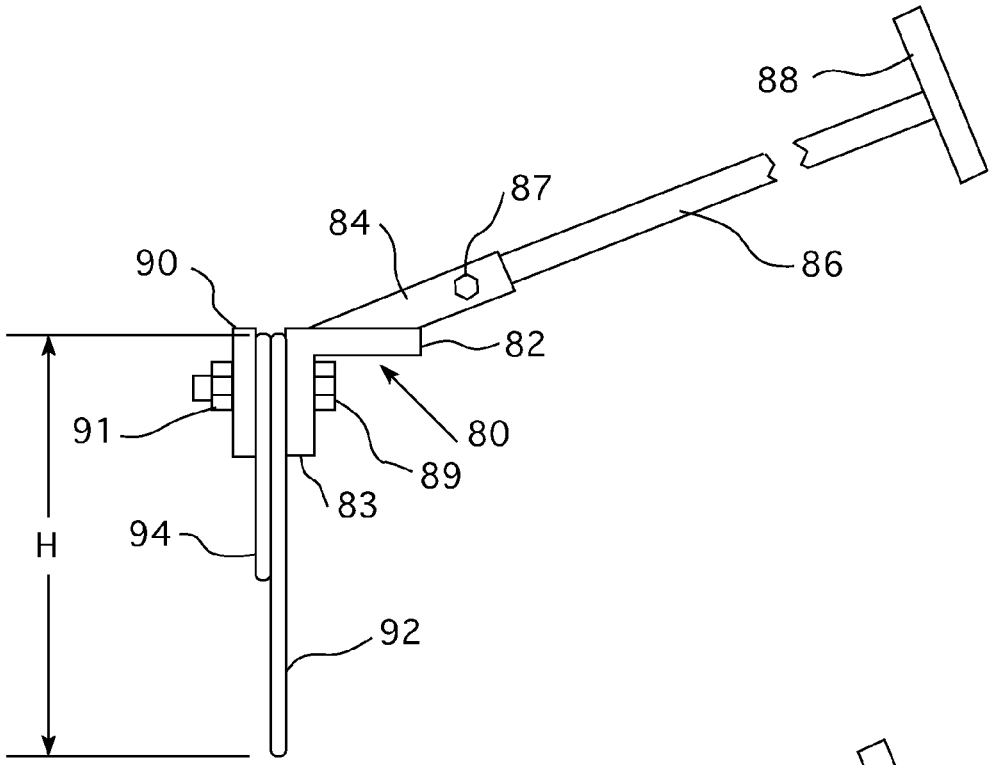
FIG. 4 is a schematic, partially exploded view of a cross-sectional illustration of another embodiment of a trowel of the present invention having two blades.

In the embodiment shown in FIG. 4, a connector 80 has a first flange 82 and an upwardly and outwardly open sleeve 84 within which is received a portion of the lower end of elongated handle 86. A suitable fastener, such as bolt 87 and a nut (not shown), secures the outwardly open sleeve 84 to the lower end of elongated handle 86 A T-shaped gripping portion 88 is provided at the upper end 104 of the elongated handle 106. The connector also has a generally perpendicular second flange 83.

In this embodiment connector 80 functions as a first weight. The connector 80 cooperates with second weight 90 to clamp first blade 92 and second blade 94 therebetween for a firm surface-to-surface interengagement thereof. The assembly of the second flange 83 and second weight 90 with the first blade 92 and second blade 94 clamped therebetween is maintained by bolt 89 and nut 91. The second blade 94 preferably has a height of about 50 to 70percent of height H of first blade 92. This serves to resist excessive flexing of blade 92. It is noted that blade 92 is positioned on the side of blade 92 opposite from the side of blade 92 to which the handle is secured.

Figure 5:
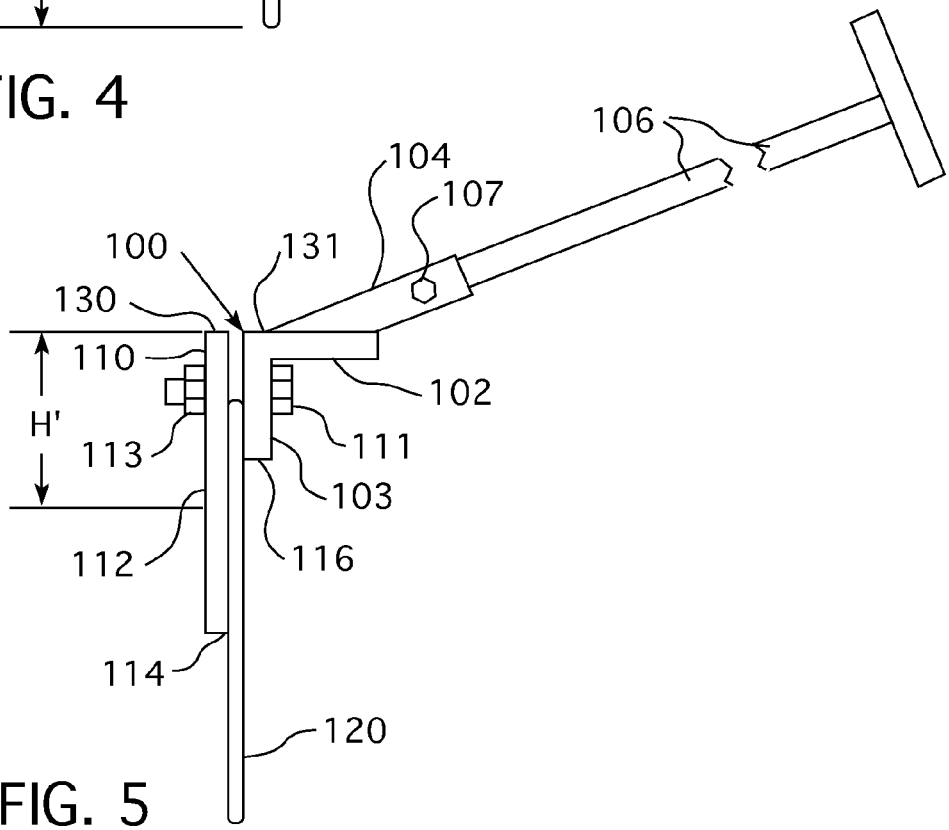
FIG. 5 is a schematic, partially exploded view of another embodiment of the invention wherein one of the two weights has a downwardly extending projection.

Referring to FIG. 5, a further modification of the invention will be considered. In this embodiment, a connector 100 has flanges 102, 103 with the lower end 104 of the elongated handle being secured within the sleeve by fastener 107. The second weight 110 has a downward projection 112 which has a lower surface 114 lower than the lower surface 116 of flange 103. Blade 120 is secured between the inner surfaces, respectively, of flange 103 and weight 110 by means of mechanical fasteners such as bolt 111 and nut 113, for example. The downward projection 112 is disposed on the opposite side of blade 120 from handle 106. The height H' of weight 110, including extension 112, from upper surface 130 to lower surface 114 is preferably about 135 to 160 percent of the height of flange from upper surface 131 to lower surface 116.

Figure 6:
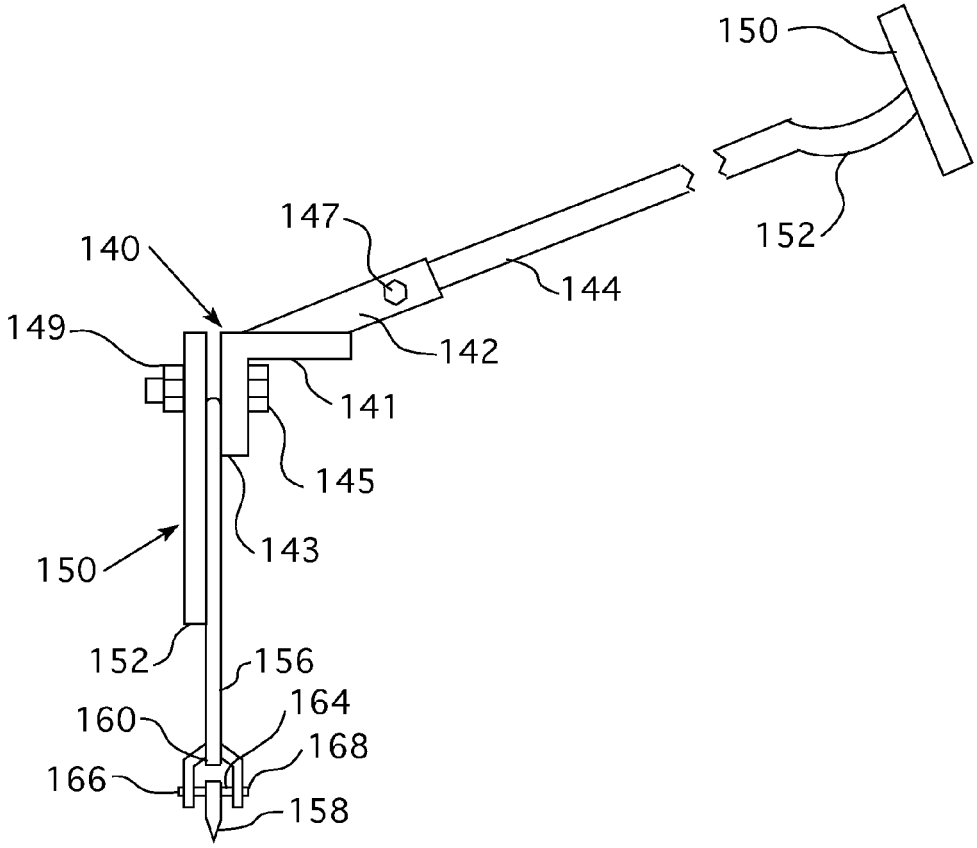
FIG. 6 is a schematic partially exploded view of a further embodiment of the invention having a replaceable cutting edge.

Referring to FIG. 6, a further embodiment of the invention will be considered. In this embodiment, connector 140 with flanges 141,143 has a sleeve 142 within which the lower portion 144 of elongated handle 148 is secured by bolt 147 with corresponding adjacent weight 150 having a downwardly depending portion 152 with blade 156 secured between flange 143 and weight 150. A plurality of fasteners, such as bolt 145 and nut 149 are used. Blade 156 in this embodiment consists of an upper portion and a lower portion 158 with the upper portion 156 having a lower end 160 which is secured to removable blade 158 by any desired means such as mechanical fasteners 164 in the form of a bolt 166 and a nut 168 secured thereto. It will be appreciated that the mechanical resistance to undesired flexure coupled with the weight 150 and flange 143 clamping the blade 156 therebetween and providing downward force under the influence of gravity is facilitated, while permitting changes of blade 158 as a blade wears by merely replacing insert cutting edge 158.

In all of these embodiments, the weights and blades are preferably coextensive in width in order to provide maximum efficiency in use. Handle 144 in this embodiment has a curved portion 152 as well as a generally transversely oriented gripping portion 150. The curved portion which may have a radius of about 8 to 14 inches serves to permit holding of the handle grip 150 at a different level in order to facilitate greater comfort for the worker.

As certain embodiments of the invention, as exemplified in FIGS. 1 through 3, have blades secured between a pair of relatively spaced weights with an interposed connector portion, use of the word "between" herein shall refer generally to something being interposed regardless of whether the interposed item is in direct contact with the items with respect to which it is interposed.

It will be appreciated therefore, that the present invention has provided an adhesive spreading trowel structured for standup use, while providing numerous other advantages. Among the advantages are the use of a pair of confronting adjacent weights or a weight and connector to facilitate clamping of the upper portions of blades, a blade or blades substantially continuously, directly or indirectly, therebetween with either a second blade or a projection on the weight disposed on the opposite side of the blade from the handle serving to limit flexing and reinforce the principal blade. Also the weights provide for more efficient use by establishing additional loading on the blade.

Whereas particular embodiments of the invention have been described herein for purposes of illustration, it will be evident to those skilled in the art that numerous variations of the details may be made without departing from the invention as set forth in the appended claims.

The invention claimed is:

1. A trowel comprising an elongated handle structured for standup spreading of materials, said handle having a manually engageable upper portion and a lower portion, a first elongated weight, an elongated connector having said handle lower portion secured to a first portion thereof and said first weight secured to a second portion thereof, a second elongated weight secured to said connector second portion on the opposite side of said second portion from said first weight the first and second weights being generally of the same size, said first weight and said second weight being structured to provide a downward force which facilitates spreading of said material, a first trowel blade secured between said first weight and said connector and extending downwardly therefrom, a second trowel blade secured between said first weight and said connector and extending downwardly therefrom, and said second blade having a height less than the height of said first blade.

2. The trowel of claim 1 including said first and second blades being secured in generally surface to surface adjacency.

3. The trowel of claim 2 including said second blade having a height of about 50 to 70 percent of the height of said first blade.

4. The trowel of claim 2 including said connector being generally L-shaped and having on one leg a tubular handle receiving bore.

5. The trowel of claim 1 including said connector having an elongated blade engaging portion, and said first and second blades being secured between said first weight and said blade engaging portion.

6. The trowel of claim 5 including said blade engaging portion having said first weight secured thereto on the opposite side of said blade engaging portion from said second weight.

7. The trowel of claim 1 including said connector being generally L-shaped.

8. The trowel of claim 7 including said second portion of said connector being on a first side of said first blade and said second blade being on the other side of said first blade.

9. The trowel of claim 1 including said blades being clamped between said first weight and said connector second portion.

10. The trowel of claim 9 including a plurality of mechanical metal fasteners securing said blades to said connector.

11. The trowel of claim 1 including said blades being resiliently flexible.

12. The trowel of claim 11 including said blades composed of sheet metal.

13. The trowel of claim 12 including said second blade serving as a leaf spring to limit flexing of said first blade.

14. A trowel comprising an elongated handle, a first elongated weight, an elongated connector having said handle secured to a first portion thereof and said first weight secured to a second portion thereof, a first trowel blade secured between said first weight and said connector and extending downwardly therefrom, a second trowel blade secured between said first weight and said connector and extending downwardly therefrom, said second blade having a height less than the height of said first blade, a second elongated weight secured to said connector second portion on the opposite side of said second portion from said first weight, said first and second blades being secured in generally surface to surface adjacency said second blade having a height of about 50 to 70 percent of the height of said first blade, and said weights being generally coextensive in width with said blades.

15. A trowel comprising an elongated handle, a first elongated weight, an elongated connector having said handle secured to a first portion thereof and said first weight secured to a second portion thereof, a first trowel blade secured between said first weight and said connector and extending downwardly therefrom, a second trowel blade secured between said first weight and said connector and extending downwardly therefrom, said second blade having a height less than the height of said first blade, a second elongated weight secured to said connector second portion on the opposite side of said second portion from said first weight, said connector having an elongated blade engaging portion, said first and second blades being secured between said first weight and said blade engaging portion, said blade engaging portion having said first weight secured thereto on the opposite side of said blade engaging portion from said second weight, and said first and second weights being generally of the same size and weight.

16. The trowel of claim 15 including mechanical fasteners securing said blades and said weights to said connector blade engaging portion.

17. A trowel comprising an elongated handle, a first elongated weight, an elongated connector having said handle secured to a first portion thereof and said first weight secured to a second portion thereof, a first trowel blade secured between said first weight and said connector and extending downwardly therefrom, a second trowel blade secured between said first weight and said connector and extending downwardly therefrom, said second blade having a height less than the height of said first blade, a second elongated weight secured to said connector second portion on the opposite side of said second portion from said first weight, said first and second blades being secured in generally surface to surface adjacency. and said first and second weights each being generally of the same weight.

* * * * *

UNITED STATES PATENT AND TRADEMARK OFFICE

CERTIFICATE OF CORRECTION

PATENT NO. : 7,464,432 B2
APPLICATION NO. : 11/023819
DATED : December 16, 2008
INVENTOR(S) : Herbert Goller It is certified that error appears in the above-identified patent and that said Letters Patent is hereby corrected as shown below:

Column 4, line 58, “first weight the first and second weights” should be --first weight, the first and second weights--.
Column 6, line 2, “surface adjacency” should be --surface adjacency,--.
Column 6, line 50, “surface adjacency. and” should be --surface adjacency, and--.

Signed and Sealed this

Nineteenth Day of May, 2009

JOHN DOLL
*Acting Director of the United States Patent and Trademark Office*